US007681721B2

(12) United States Patent
Chao et al.

(10) Patent No.: US 7,681,721 B2
(45) **Date of Patent: *Mar. 23, 2010**

(54) SYSTEM FOR SELECTING EYEGLASSES

(75) Inventors: David Chao, Saratoga, CA (US); Yu-Shun Lee, Chiayi (TW)

(73) Assignee: Contour Optik, Inc., Chiayi (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/355,013

(22) Filed: Jan. 16, 2009

(65) Prior Publication Data

US 2009/0120812 A1 May 14, 2009

Related U.S. Application Data

(63) Continuation of application No. 11/104,852, filed on Apr. 13, 2005, now Pat. No. 7,490,717.

(60) Provisional application No. 60/561,906, filed on Apr. 14, 2004.

(51) Int. Cl.
*A45C 11/04* (2006.01)

(52) U.S. Cl. ..... 206/6

(58) Field of Classification Search ..... 206/5, 206/6, 349, 372, 373; 211/85.1
See application file for complete search history.

(56) References Cited

U.S. PATENT DOCUMENTS

| | | | | |
|---|---|---|---|---|
| 4,817,191 | A * | 3/1989 | Adams | 455/351 |
| 5,235,822 | A * | 8/1993 | Leonovich, Jr. | 206/542 |
| 6,026,950 | A | 2/2000 | Wisniewski | |
| 6,662,945 | B1 | 12/2003 | Chang | |
| 6,726,004 | B2 * | 4/2004 | Watson | 206/6 |
| 6,772,878 | B1 | 8/2004 | Liebers et al. | |
| 2004/0182730 | A1 | 9/2004 | Lee | |

* cited by examiner

*Primary Examiner*—Luan K Bui
(74) *Attorney, Agent, or Firm*—Greenberg Traurig, LLP

(57) ABSTRACT

In one embodiment of the present invention a system is provided for allowing a consumer to easily match a suitable pair of primary eyeglasses with a suitable pair of auxiliary eyeglasses. In one example (which example is intended to be illustrative and not restrictive), the suitable pair of primary eyeglasses may be matched with the suitable pair of auxiliary eyeglasses without damaging or opening the package which contains the pair of auxiliary eyeglasses. In another example (which example is intended to be illustrative and not restrictive), the system may comprise a package and/or a displayer.

9 Claims, 9 Drawing Sheets

SYSTEM FOR SELECTING EYEGLASSES

RELATED APPLICATIONS

This application is a continuation of U.S. Ser. No. 11/104,852, filed Apr. 13, 2005, now U.S. Pat. No. 7,490,717, which claims the benefit of U.S. Provisional Application Ser. No. 60/561,906, filed Apr. 14, 2004. Each of the aforementioned applications is incorporated herein by reference in its entirety.

FIELD OF THE INVENTION

In one embodiment of the present invention a system is provided for allowing a consumer to easily match a suitable pair of primary eyeglasses with a suitable pair of auxiliary eyeglasses.

In one example (which example is intended to be illustrative and not restrictive), the suitable pair of primary eyeglasses may be matched with the suitable pair of auxiliary eyeglasses without damaging or opening the package which contains the pair of auxiliary eyeglasses.

In another example (which example is intended to be illustrative and not restrictive), the system may comprise a package and/or a displayer.

For the purposes of describing and claiming the present invention, the term "displayer" is intended to refer to a structure for holding packaged and/or unpackaged eyeglasses (e.g., a display case, a display rack and the like).

BACKGROUND OF THE INVENTION

Auxiliary eyeglasses (e.g., having a tint and/or prescription) are known for attachment to a primary pair of eyeglasses or used together with a conventional eyeglasses.

Such auxiliary eyeglasses typically include a frame which is attached to part or all of the primary eyeglasses or having the devices of a conventional eyeglasses (e.g., including a frame and two temple legs) but can be used together with a conventional eyeglasses.

Further, such auxiliary eyeglasses may be adjustable to fit a range of primary eyeglasses or non-adjustable to fit a specific size of primary eyeglasses.

Figure 1:
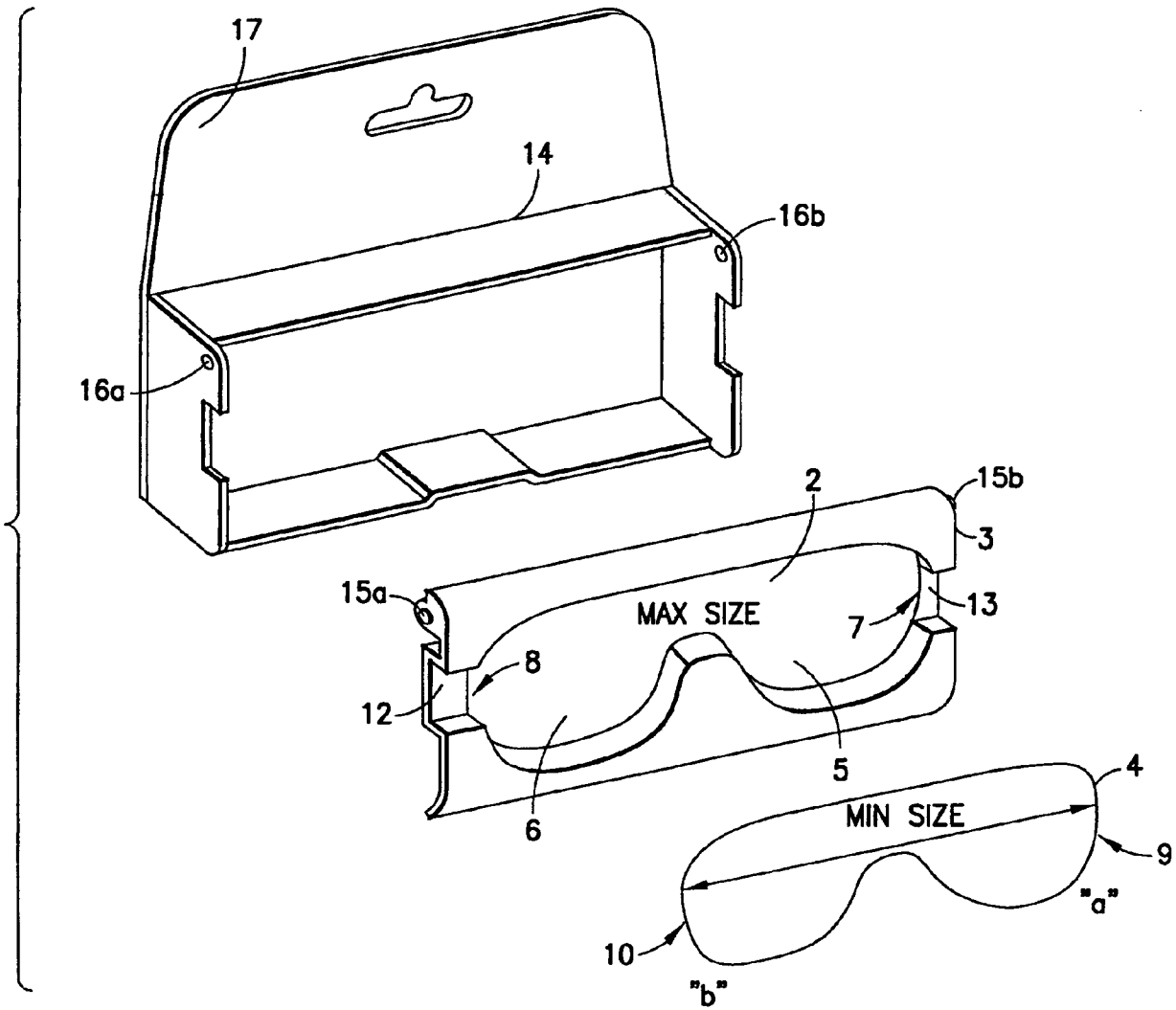
FIG. 1 shows an exploded perspective view of a package for receiving therein a pair of auxiliary eyeglasses according to an embodiment of the present invention.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Referring now to FIGS. 1-6, a package I for receiving therein a pair of adjustable auxiliary eyeglasses (not shown) is seen. As described in more detail below, this package 1 may be useful in matching a suitable pair of primary eyeglasses (see primary glasses 11 of FIG. 2) with a suitable pair of auxiliary eyeglasses. Package 1 may include a glasses-like-shaped cavity 2 formed on a 15 cover portion 3 of the package 1 as well as a glasses-like-shaped pattern 4 disposed within the cavity 2.

In one example (which example is intended to be illustrative and not restrictive), the glasses-like-shaped pattern 4 may be a separate element attached to the glasses-like-shape cavity 2 (as seen in FIG. 1).

In another example (which example is intended to be illustrative and not restrictive), the glasses-like-shaped pattern 4 may be formed in the glasses-like-shape cavity 2, for example, by printing the glasses-like shaped pattern 4 on the glasses-like-shaped cavity 2.

In any case, the glasses-like-shaped cavity 2 may comprise a first lens-shaped portion 5 and a second lens-shaped portion 6. The side outer end of the first lens-shaped portion 5 defines an edge "A" (call-out number 7). The side outer end of the second lens-shaped portion 6 defines an edge "B" (call-out number 8). The planar distance between edge "A" and edge "B" presents a reasonable maximum size for primary eyeglasses which can be engaged with the adjustable auxiliary eyeglasses (not shown) disposed within package 1. Further, the glasses-like-shaped pattern 4 comprises a side edge "a" (call-out number 9) and a side edge "b" (call-out number 10) at its far outer ends. The planar distance of edges "a" and "b" of the glasses-like-shaped pattern 4 indicates a reasonable minimum size of the primary eyeglasses which can be engaged with the adjustable auxiliary eyeglasses (not shown) disposed within package 1. Thus, a suitable range for the primary eyeglasses is defined between the edges "a" (call-out number 9) and "A" (call-out number 7) as well as "b" (call-out number 10) and "B" (call-out number 8).

Figure 6:
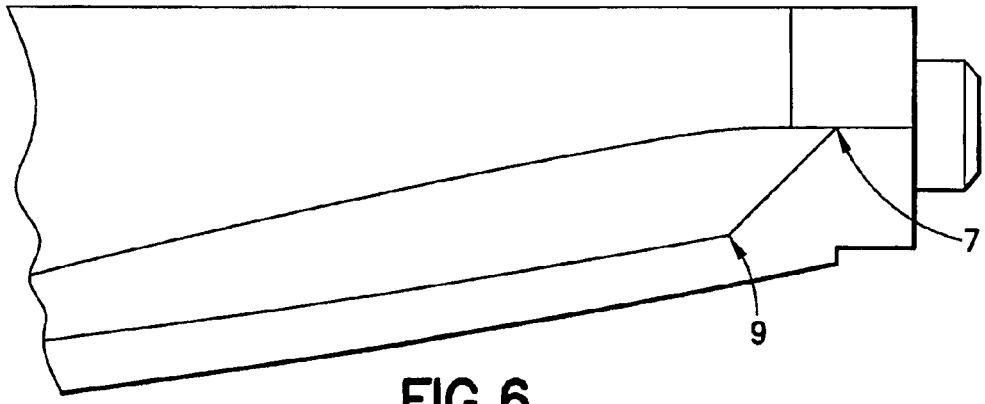
FIG. 6 shows detail of a sloping surface on the inside of a cavity.

In another example (which example is intended to be illustrative and not restrictive), the glasses-like-shaped cavity 2, at the suitable range for the primary eyeglasses, may slope from edge "A" (call-out number 7) to edge "a" (call-out number 9)

and edge "B" (call-out number 8) to edge "b" (call-out number 10). This slope is shown in FIG. 6 with reference to edges "A" and "a" (the slope with reference to edges "B" and "b", although not shown, may be similar).

Figure 3:
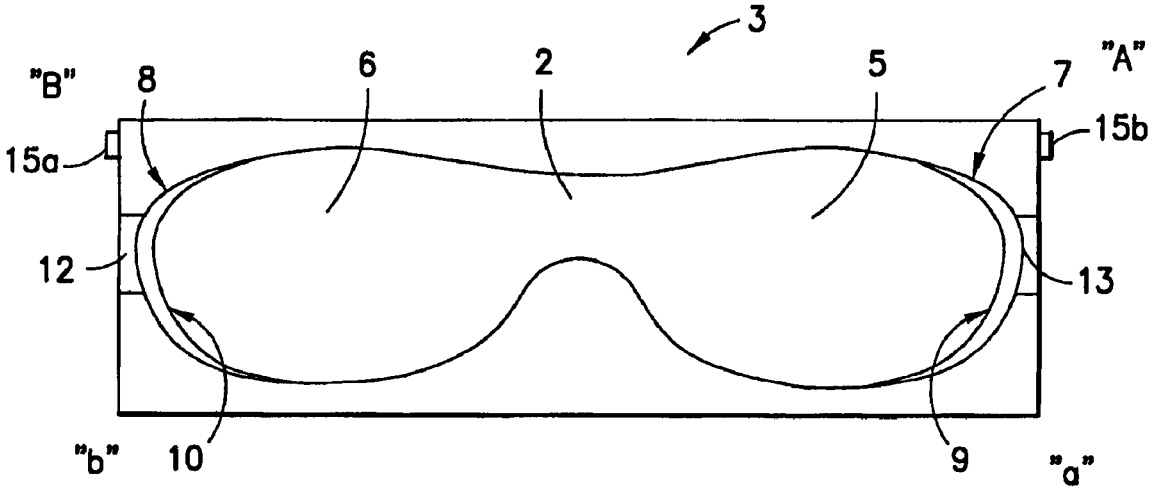
FIG. 3 shows detail of a front portion of the package of FIGS. 1 and 2.
Figure 4:
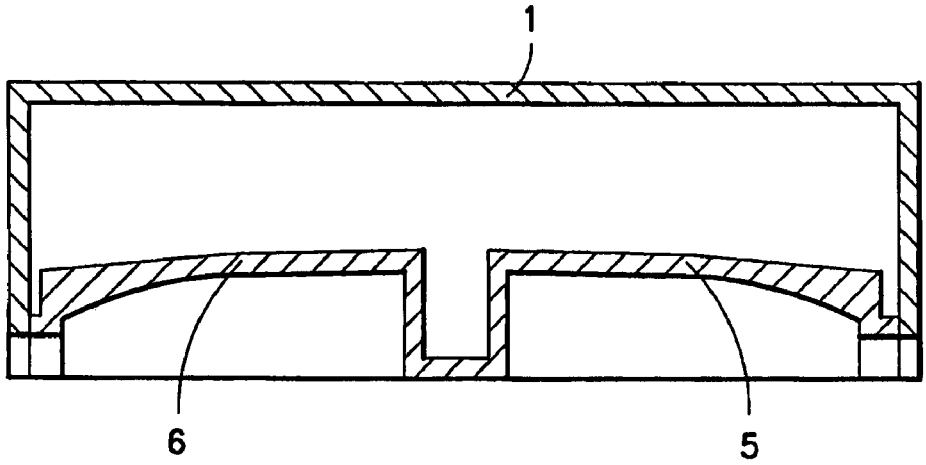
FIG. 4 shows an example configuration of the inside of a cavity (this Fig. comprises a cross-sectional view of a package taken along line IV-IV of FIG. 2)

In another example (which example is intended to be illustrative and not restrictive), the glasses-like-shaped cavity 2 may be formed as shown in FIG. 3).

Figure 5:
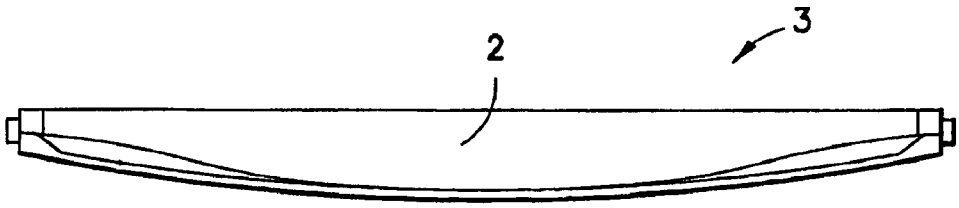
FIG. 5 shows an example configuration of the inside of a cavity (this Fig. comprises a cross-sectional view of a package taken along line V-V of FIG. 2)

In another example (which example is intended to be illustrative and not restrictive), the glasses-like-shaped cavity 2 may be formed as a concave curve (see FIG. 5). This curve may generally correspond to the curve of the primary eyeglasses 11 (shown in FIG. 2).

Figure 2:
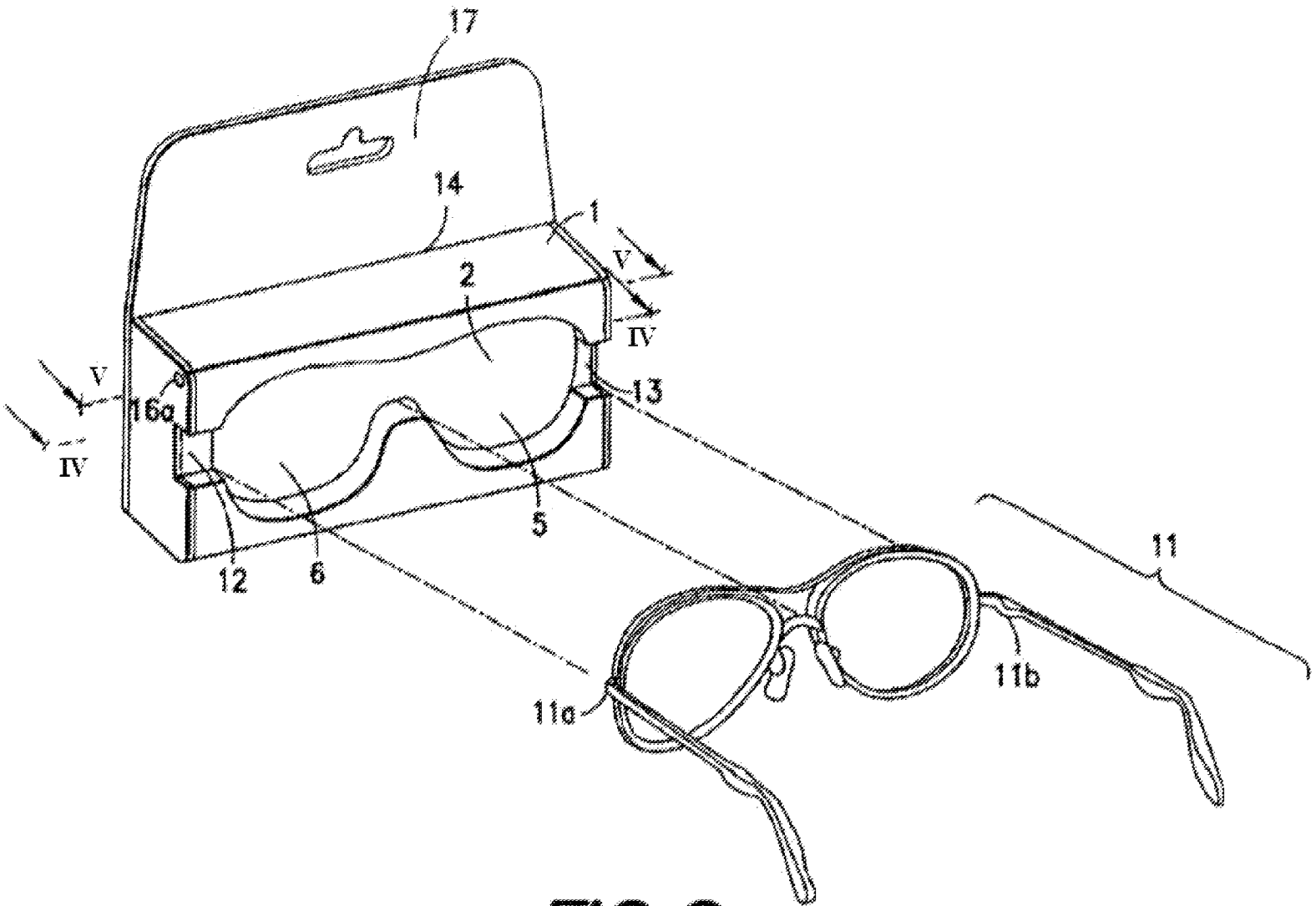
FIG. 2 shows a perspective view of an assembled package similar to that of FIG. 1 according to an embodiment of the present invention.

In another example (which example is intended to be illustrative and not restrictive), two slots 12 and 13 respectively located at the left and right side of the glasses-like-shaped cavity 2 may be provided for receiving the temple portions 11*a* and 11*b* of the primary eyeglasses 11 (as shown in FIG. 2).

In another example (which example is intended to be illustrative and not restrictive), the package 1 may comprise a body portion 14. The body portion 14 and the cover portion 3 may be pivotally coupled together by hinge elements 15*a* and 15*b* coopering with holes 16*a* and 16*b*.

In another example (which example is intended to be illustrative and not restrictive), either or both the body portion 14 and the cover portion 3 may be fully or partially transparent or translucent. Further, a back card 17 may be disposed on the body portion 14 (to become a part of the package 1).

Figure 7A:
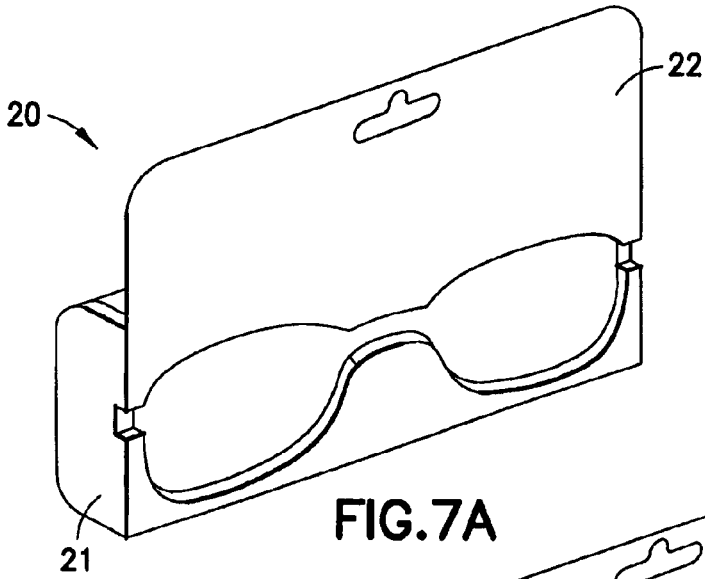
FIGS. 7A and 7B show perspective views of a package according to an embodiment of the present invention.
Figure 7B:
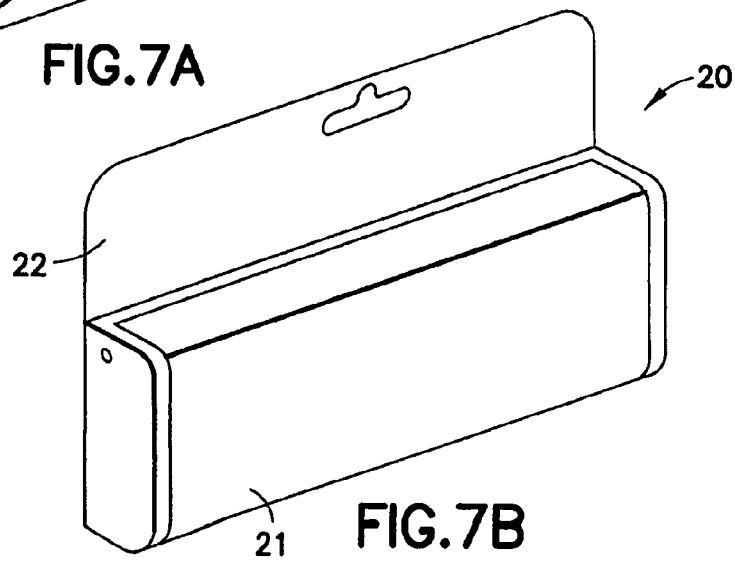

Referring now to FIGS. 7A and 7B, a package 20 for receiving therein a pair of auxiliary eyeglasses inside (not shown) may comprise a container portion 21 and a back card portion 22. An easy-fitting-on mechanism (e.g., such as including glasses-like-shape cavity 2 and glasses-like-shaped pattern 4 discussed above) may be disposed adjacent the back card portion 22 at the rear side of the container portion 21. In one example (which example is intended to be illustrative and not restrictive), the cover of the container portion 21 may be fully or partially transparent or translucent.

Figure 8A:
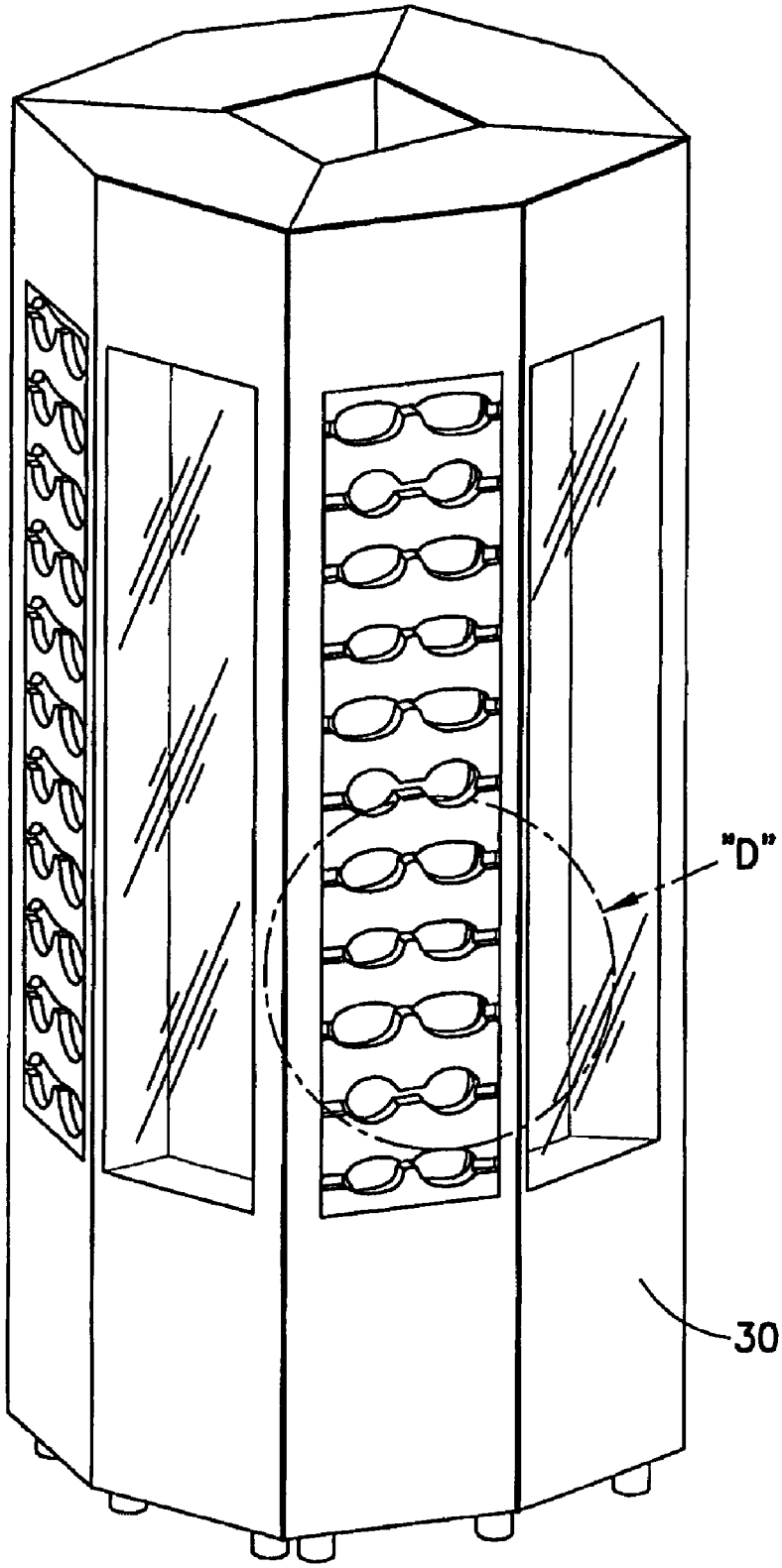
FIGS. 8A, 8B, 9 and 10 show views of displayers according to embodiments of the present invention.
Figure 8B:
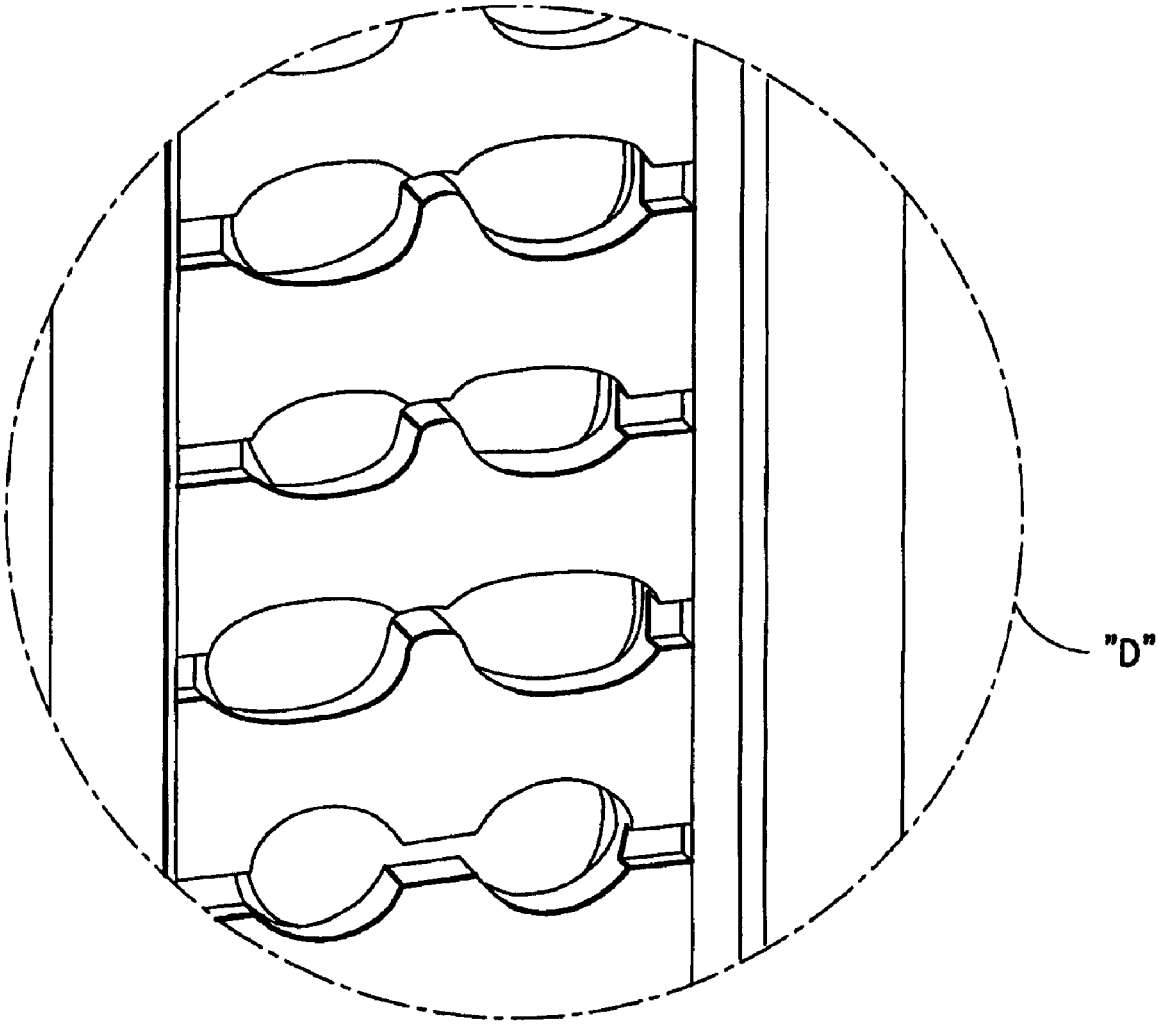

Referring now to FIGS. 8A and 8B, it is seen that a plurality of easy-fitting-on mechanisms (e.g., such as each including glasses-like-shape cavity 2 and glasses-like-shaped pattern 4 discussed above) may be disposed on a displayer 30 (e.g., for presentation to a purchaser). Of note, FIG. 8B shows detail "D" of the circled section of FIG. 8A.

Figure 9:
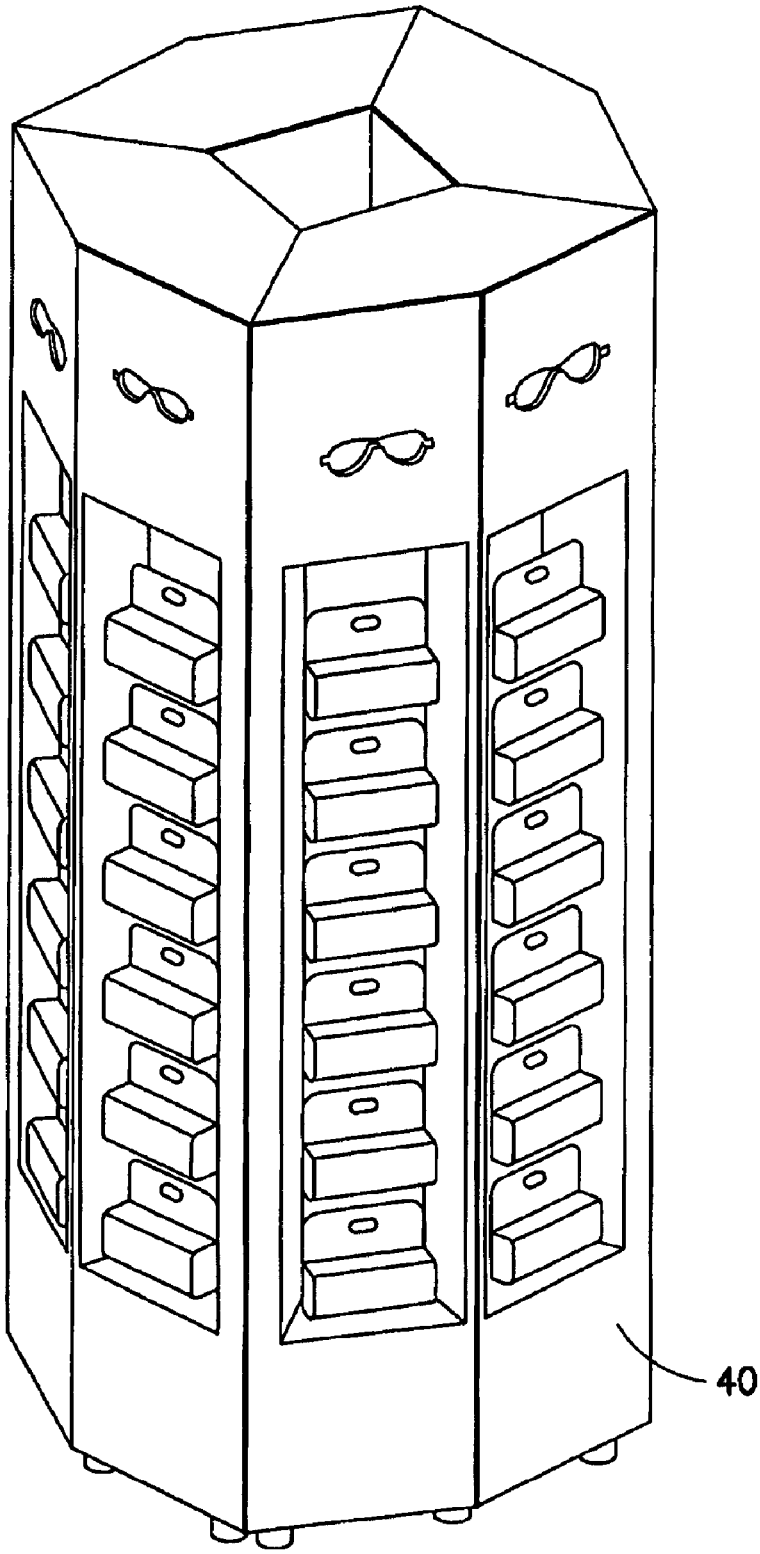

Referring now to FIG. 9, it is seen that a plurality of packages, each of which may (or may not) include an easy-fitting-on mechanism (e.g., such as including glasses-like-shape cavity 2 and glasses-like-shaped pattern 4 discussed above) may be disposed on a displayer 40 (e.g., for presentation to a purchaser). In addition, it is seen that a plurality of easy-fitting-on mechanisms (e.g., such as each including glasses-like-shape cavity 2 and glasses-like-shaped pattern 4 discussed above) may be disposed on the displayer 40.

Figure 10:
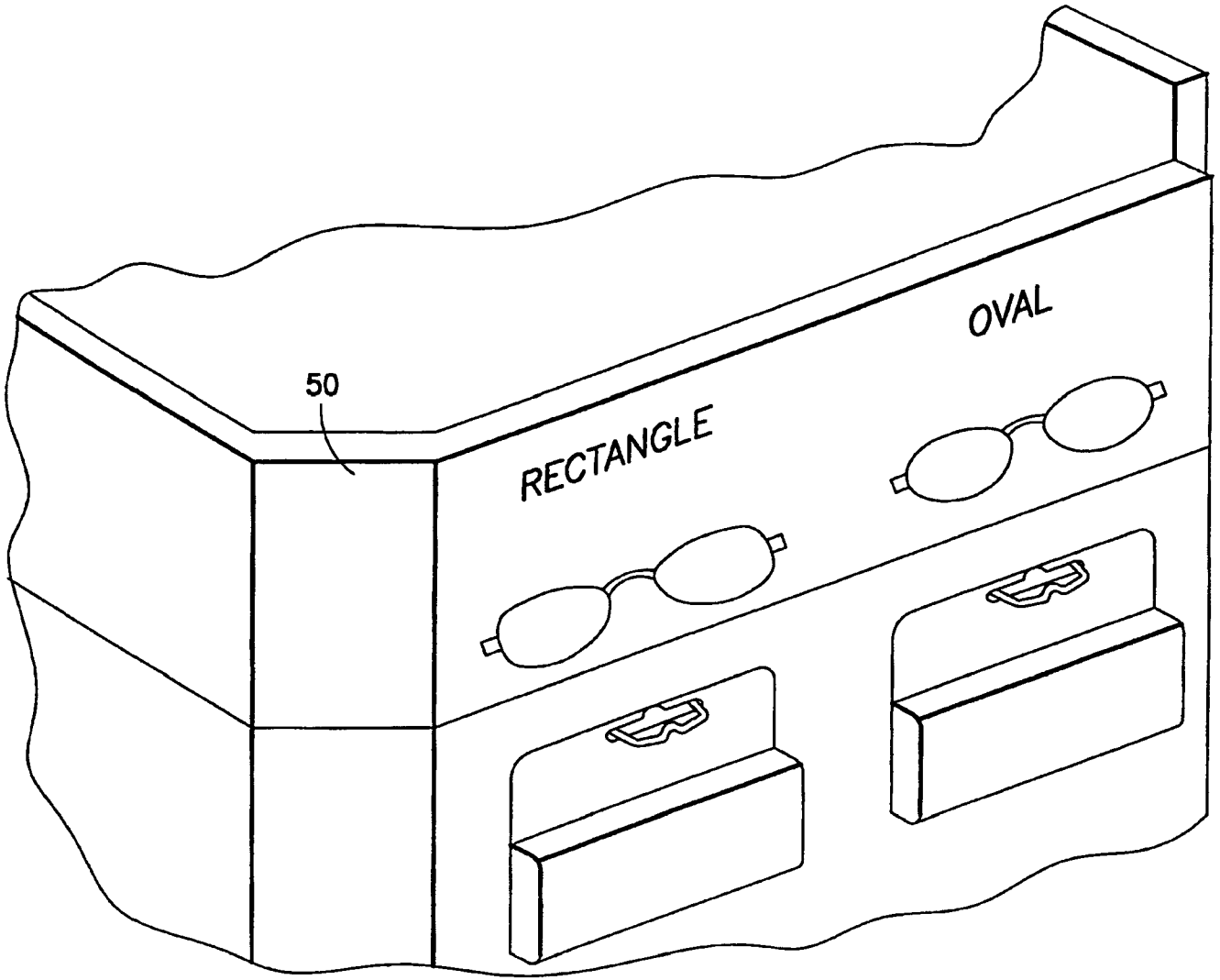

Referring now to FIG. 10, it is seen that a plurality of packages, each of which may (or may not) include an easy-fitting-on mechanism (e.g., such as including glasses-like-shape cavity 2 and glasses-like-shaped pattern 4 discussed above) may be disposed on a displayer 50 (e.g., for presentation to a purchaser). In addition, it is seen that a plurality of easy-fitting-on mechanisms (e.g., such as each including glasses-like-shape cavity 2 and glasses-like-shaped pattern 4 discussed above) may be disposed on the displayer 50 (various size and/or shape indicia may be provided).

Figure 11:
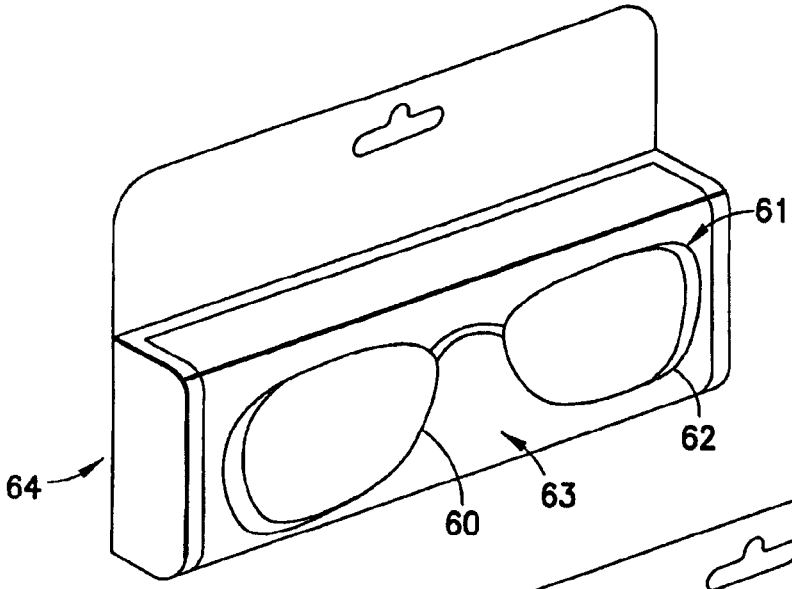
FIG. 11 shows a perspective view of a package according to an embodiment of the present invention.

Referring now to FIG. 11, another embodiment of the present invention provides an easy-fitting-on mechanism 60 for matching a suitable pair of primary eyeglasses with a suitable pair of auxiliary eyeglasses. This easy-fitting-on mechanism 60 may comprise a large glasses-like-shaped pattern 61 and a small glasses-like-shaped pattern 62, both of which may be formed on a front portion 63 of a package 64 (wherein package 64 is configured for receiving a pair of adjustable auxiliary eyeglasses therein). The large glasses-like-shaped pattern 61 may comprise a reasonable maximum size for a pair of primary eyeglasses which can be engaged with the adjustable auxiliary eyeglasses within the package 64. The small glasses-like-shaped pattern 62 may comprise a reasonable minimum size for a pair of primary eyeglasses which can be engaged with the adjustable auxiliary eyeglasses within the package 64. The easy-fitting-on mechanism 60 may be disposed on a package configured for receiving therein a pair of auxiliary eyeglasses (as shown) and/or may be disposed on a displayer (as discussed elsewhere in this application).

Figure 12:
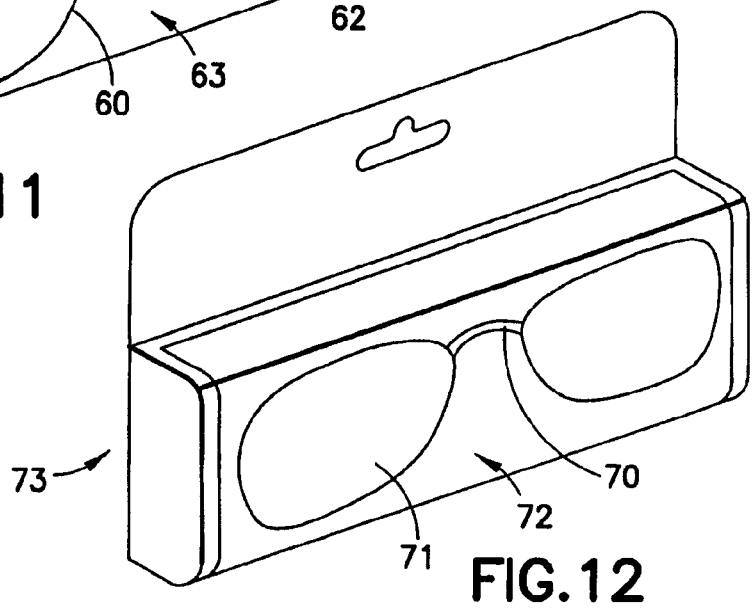
FIG. 12 shows a perspective view of a package according to an embodiment of the present invention.

Referring now to FIG. 12, another embodiment of the present invention provides an easy-fitting-on mechanism 70 for matching a suitable pair of primary eyeglasses with a suitable pair of non-adjustable auxiliary eyeglasses. As shown in this FIG. 12, the easy-fitting-on mechanism 70 may comprise a fixed size of a glasses-like-shaped pattern 71 formed, for example, on the front portion 72 of a package 73 (wherein package 73 is configured for receiving a pair of non-adjustable auxiliary eyeglasses therein). The fixed size of glasses-like-shaped pattern 71 may be a reasonable size for a pair of primary eyeglasses to be mated with the pair of non-adjustable auxiliary eyeglasses within the package 73. The easy-fitting-on mechanism 70 may be disposed on a package configured for receiving therein a pair of non-adjustable auxiliary eyeglasses (as shown) and/or may be disposed on a displayer (as discussed elsewhere in this application).

Figure 13:
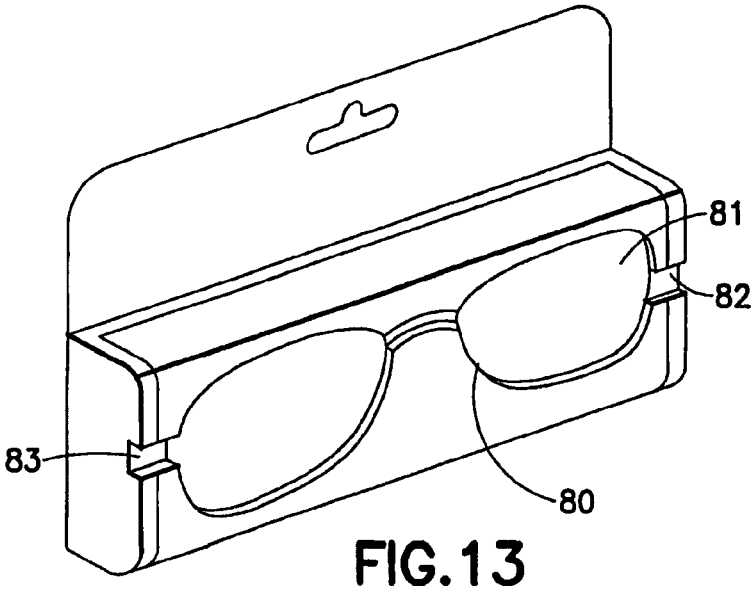
FIG. 13 shows a perspective view of a package according to an embodiment of the present invention.

Referring now to FIG. 13, another embodiment of the present invention provides an easy-fitting-on mechanism 80 for matching a suitable pair of primary eyeglasses with a suitable pair of non-adjustable auxiliary eyeglasses. As shown in this FIG. 13, the easy-fitting-on mechanism 80 may comprise a glasses-like-shaped cavity 81 and two slots 82 and 83 formed at the far side ends of the glasses-like-shaped cavity 81. The easy-fitting-on mechanism 80 may be disposed on a package configured for receiving therein a pair of non-adjustable auxiliary eyeglasses (as shown) and/or may be disposed on a displayer (as discussed elsewhere in this application).

While a number of embodiments of the present invention have been described, it is understood that these embodiments are illustrative only, and not restrictive, and that many modifications may become apparent to those of ordinary skill in the art. For example, the packaging and/or the displayer may include any desired size and/or shape indicators to aid in matching a suitable pair of primary eyeglasses with a suitable pair of auxiliary eyeglasses.

What is claimed is:

1. A packaging system, comprising:

a container, having a pair of adjustable auxiliary eyeglasses therein;

a cavity disposed on an outer surface of the container; and a pattern disposed within the cavity, wherein the pattern is sufficiently designed to have a glasses-like shape which allows to match the pair of adjustable auxiliary eyeglasses within the container to a pair of primary eyeglasses having a minimum size suitable for use with the pair of adjustable auxiliary eyeglasses.

2. The system of claim 1, wherein the pattern comprises a separate part placed within the cavity.

3. The system of claim 1, wherein the container comprises a body portion and a cover portion.

4. The system of claim 3, wherein the cover portion is hingedly mounted to the body portion.

5. The system of claim 1, wherein the container comprises a back card.

6. The system of claim 1, wherein the cavity comprises first and second slots, each of the first and second slots being configured to receive a respective temple portion of a pair of primary eyeglasses placed within the cavity.

7. The system of claim 3, wherein the cavity is disposed on the cover portion.

8. The system of claim 1, wherein an inner surface of the cavity slopes toward the pattern.

9. The system of claim 1, wherein at least a portion of the pattern is separately disposed within the cavity.

* * * * *